US005813361A

United States Patent [19]

Milliman

[11] Patent Number: 5,813,361

[45] Date of Patent: Sep. 29, 1998

[54] BOAT MOTOR HEATER

[76] Inventor: John G. Milliman, 6223 Pasture Dr., Castle Hayne, N.C. 28429

[21] Appl. No.: 846,275

[22] Filed: Apr. 30, 1997

[51] Int. Cl.[6] ..... B63B 17/00

[52] U.S. Cl. ..... 114/361; 440/900; 219/529; 219/535

[58] Field of Search ..... 150/154, 157, 150/166, 901; 296/136; 114/361; 440/113, 900; 219/529, 549, 535, 542, 202–206

[56] References Cited

U.S. PATENT DOCUMENTS

| | | | |
|---|---|---|---|
| 2,417,636 | 3/1947 | Ditzler et al. . | |
| 2,434,784 | 1/1948 | Bardin . | |
| 2,498,113 | 2/1950 | Milner . | |
| 2,666,840 | 1/1954 | Poirier | 296/136 |
| 3,010,124 | 11/1961 | Dawson . | |
| 3,132,228 | 5/1964 | Eisler | 219/202 |
| 3,178,561 | 4/1965 | Wolf | 219/549 |
| 3,213,994 | 10/1965 | Hohler | 219/205 |
| 3,293,405 | 12/1966 | Costanzo | 219/529 |
| 3,870,875 | 3/1975 | Altimus . | |
| 4,058,704 | 11/1977 | Shimizu | 219/549 |
| 4,197,449 | 4/1980 | Fessenden | 219/549 |
| 4,210,073 | 7/1980 | Weiss . | |
| 4,633,061 | 12/1986 | Arikawa | 219/202 |
| 4,916,290 | 4/1990 | Hawkins . | |
| 5,072,683 | 12/1991 | Colonna . | |
| 5,137,481 | 8/1992 | Wengler . | |
| 5,660,136 | 8/1997 | Pignatelli et al. | 114/361 |

*Primary Examiner*—Ed L. Swinehart
*Attorney, Agent, or Firm*—Rhodes, Coats, Bennett, L.L.P.

[57] ABSTRACT

A protective cover for an outboard motor mounted on a boat transom including a flexible, bag-shaped covering to enclose the motor, a closure attached to the covering at the neck to close the neck tightly around an upper part of the motor adjacent the transom; a resistance heating element secured to the interior wall of the covering; and a thermostat to activate the heating element when the temperature within the cavity formed by the covering is below a predetermined temperature.

13 Claims, 1 Drawing Sheet

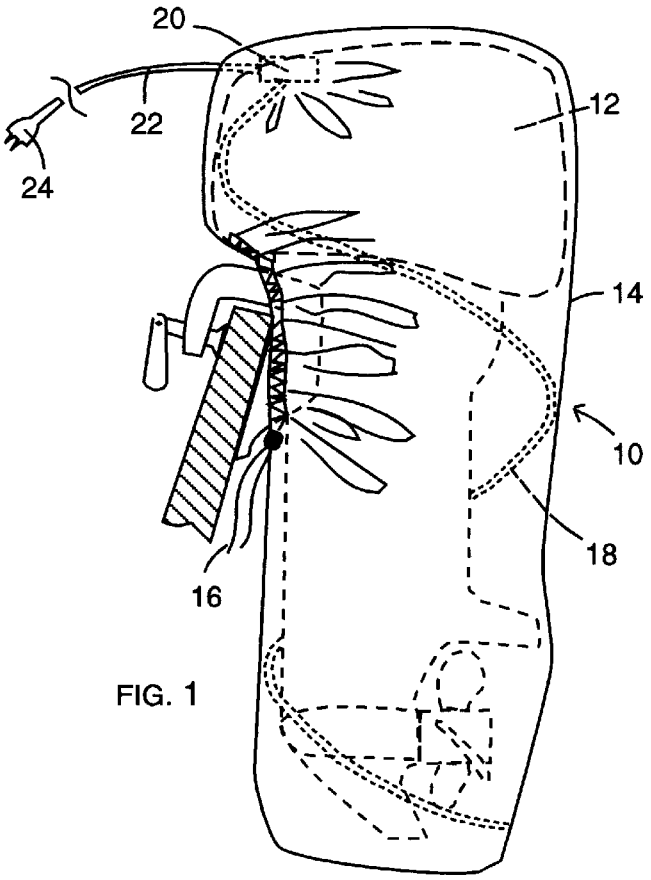
FIG. 1
FIG. 2
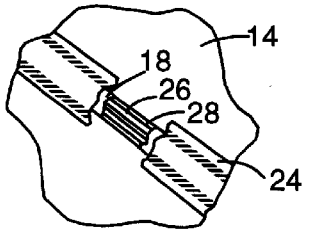
FIG. 3
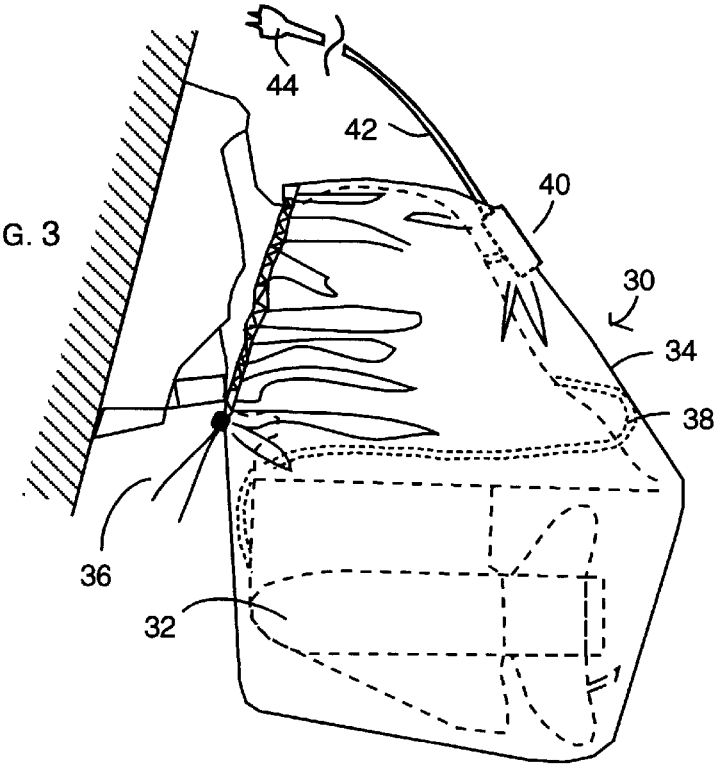

BOAT MOTOR HEATER

BACKGROUND OF THE INVENTION (1). Field of the Invention

The present invention relates generally to a flexible cover adapted to fix over all or part of an outboard or inboard-outboard motor, and in particular to a cover for a water-cooled boat motor, that includes a thermostatically controlled heating element to heat the motor when exterior temperatures are at or below freezing, thus preventing damage to the motor.

(2). Description of the Prior Art

The propulsion means for smaller boats, particularly boats used for recreational purposes, is either an outboard motor attached to the boat transom, or an inboard-outboard motor with an interior mounted engine connected to an exterior drive and propeller by a drive shaft extending through the boat transom. These propulsion devices, collectively referred to herein as boat motors, are normally water-cooled. That is, the motor includes a pump that pumps water through conduits adjacent to the internal combustion engine and a drive shaft to cool the motor while the motor is running.

Although smaller boats may be stored in the water or in storage facilities, recreational boats in particular are commonly mounted and stored on trailers when not in use. Storage is usually in an external or unheated environment where the boat motor is exposed to exterior temperatures. Since the motors are water-cooled, there is often water left within the motors can freeze during outdoor storage of the boats during cold weather, thereby causing considerable damage to the boat motors.

While it is well known in the art to provide a flexible covering, e.g., a canvas cover, for outboard motors, and the external portion of inboard-outboard motors, these prior art covers are primarily used to prevent debris and rain from contacting the motor, and provide little protection of the motor from freezing temperatures.

Flexible boat covers have been modified for various purposes. For example, U.S. Pat. No. 2,434,784 to Bardin describes a boat motor cover that includes a drain pan to collect oil and gasoline dripping from the motor; U.S. Pat. No. 2,498,113 to Milner describes a cover that can also be used as a seat cushion; U.S. Pat. No. 3,870,875 to Altimus describes a boat motor cover for an outboard-inboard motor that has a taillight mounted at the rear of the cover; and U.S. Pat. No. 5,137,481 to Wengler describes a motor carrier in the form of a flexible cover that is strapped over the motor.

The prior art, however, has not taught or suggested the modification of a boat cover so that it would be capable of protecting the boat motor from damage due to cold weather. Since boat motors can be quite costly, a covering having this feature would result in considerable convenience and reduced risk of financial loss.

SUMMARY OF THE INVENTION

The present invention is directed to a flexible boat motor cover including a heating element that is activated at lower temperatures to prevent damage to the enclosed motor.

Outboard motors to be protected by the present invention are of various shapes and dimensions, but are generally comprised of a water-cooled internal combustion engine, a drive shaft extending downwardly from the engine, and a propeller connected at the distal end of the drive shaft. The motor also includes a cowling or housing over the engine, as well as a drive shaft housing over the drive shaft. A water pump, connected to the drive shaft, is normally located in the drive shaft housing to pump water though conduits in the drive shaft housing and around the engine for cooling purposes. A mounting bracket is used to support the motor on the boat transom.

An inboard-outboard motor has essentially the same elements, with the primary difference being that the internal combustion engine is located within the interior of the boat. Other sections of the motor, and specifically the drive shaft, are outside the boat, and thus most exposed to external temperatures.

Freezing of residual water within the water conduits in the drive shaft can cause considerable damage. Moreover, the temperature of the metal drive shaft will be conducted to the engine, even if the engine is somewhat protected by being within the boat, causing water with in the engine to freeze in colder temperatures.

In accordance with the present invention, a heated, protective cover is placed over the motor, or exposed sections of the motor behind the boat transom to maintain the temperature inside the cover at an elevated level relative to the external temperature, so that water within the motor will not freeze. Essentially, this cover is comprised of a flexible covering shaped to form a cavity to enclose the motor, a means for securing the cover over the motor, a heating element within the interior of the covering that can be connected to a source of electricity, and a thermostat to activate the heating element when the temperature is below a predetermined level.

The covering of the present invention will normally be constructed of a waterproof, nonflammable flexible fabric. Suitable fabrics include canvas, duck and coated fiberglass fabric. The fabric can be sewn in a known manner to form a shaped covering, or bag, generally conforming to the outer dimensions of the motor, or parts of the motor, to be covered. It is not critical from the standpoint of performance for the covering to closely conform to the motor's dimensions.

In fact, commercial versions of the covering may be of standard sizes, so that a covering may fit closely on one type of motor, and relatively loosely on another. However, a relatively close fit has the advantages that less space within the covering will require heating, the covering will be less bulky, and the covering will be less costly to produce, due to the lower quantity of material.

In order to ensure a tight fit over the motor, and thus reduced heat loss during use, the covering includes an opening through which the motor is inserted into the covering. The periphery or neck of the opening will be fitted over the part of the motor adjacent to the boat transom when the cover is in position for use. Since this part of the motor normally has a smaller circumference than the circumference of other parts of the motor over which the covering is drawn, a closure is used around the neck of the covering to tighten the neck closely around the motor, thus minimizing heat loss. This closure may be a draw string fitted within a loop of fabric around the neck of the covering. Alternatively, the neck may be closed using hook and loop fastener material, such as that sold under the trademark Velcro®, or an elastic cord within a sleeve around the periphery of the bag neck.

The heating element is a resistance heater of the type known as a strip heating element comprised of an elongated loop of conductive element, e.g., a wire loop, grid, or tape, covered by an insulating material, e.g., rubber, plastic or Mylar®. When heated, the heating element radiates heat from the conductive element. The dimensions of the heating element, and the amount of heat radiated, will be sized to the dimensions of the area being heated within the cover. If a wire loop or tape, the heating element will be from about 3 to about 6 feet in length.

The heating element is secured within the bag or covering by attaching the heating element to the interior wall of the covering. The heating element may be secured to the interior covering wall by taping or sewing the heating element to the wall. Preferably, the heating element is attached in a spiral configuration around the wall interior to provide uniform heating. It is not critical, however, for the heating element to extend about the entire interior surface, since the heat will radiate throughout the cavity.

The heating element is connected to one end of an electrical cord, with the other end of the cord terminating in an electrical plug, so that the heating element can be plugged into a source of electricity, such as a wall outlet. In order to activate the heating element only when the temperature is below a predetermined level, the cord extends through a thermostat positioned between the heating element and the electric plug, and preferably within the covering cavity or interior.

In use, the covering is drawn over the motor, or external parts of the motor, with the neck of the covering being positioned around the motor near the boat transom. The neck is then drawn tightly about the motor with the closure. The heating element is connected to a source of electricity, and the thermostat is set, or preset, to the desired activation temperature, e.g., 32° F. When the temperature around the exterior of the cover falls to the activation temperature, the heating element is activated, heating the interior of the cover, thus preventing the motor from freezing. The thermostat can be wholly within the covering, or connected to a sensor within the covering, so that the heating element is deactivated when the temperature within the covering reaches a second predetermined higher level, e.g., 40° F. When the temperature falls below the first predetermined level, the heating cycle is repeated.

Accordingly, one aspect of the present invention is to provide a protective cover for a boat motor that includes a flexible covering adapted to enclose at least a part of the motor, the covering having an interior wall; a heating element within the covering; and a control means for activating the heating element when the temperature within the covering is below a predetermined temperature.

It is another aspect of the invention to provide a protective cover for an outboard motor attached to the transom of a boat with a mounting bracket including a flexible, bag-shaped covering having a neck, the covering being adapted to enclose the motor; a closure attached to the covering at the neck, the closure being adapted to secure the neck adjacent the mounting bracket; a heating element secured to the interior wall of the covering, the heating element including a resistance heating strip and an electrical cord to connect the strip to an electrical outlet; and a thermostat between the strip and the outlet to activate the heating element when the temperature within the covering is below a predetermined temperature.

These and other aspects of the present invention will become apparent to those skilled in the art after a reading of the following description of the preferred embodiment.

BRIEF DESCRIPTION OF THE DRAWINGS

FIG. 1 is side view of a cover for an outboard motor, with the heating element shown as a dotted line. The motor is also shown by a dotted line to illustrate positioning of the cover.

FIG. 2 illustrates a section of the heating strip secured to the inner wall of the covering with adhesive tape.

FIG. 3 is side view of a cover for an inboard-outboard motor. As in FIG. 1, the heating element and the exterior part of the motor are shown by dotted lines.

DETAILED DESCRIPTION OF THE INVENTION

The specific embodiments are illustrated with the motors in an upright position for ease in describing the invention. The angle of the motor is not of importance to the invention, however, and it is to be understood that the motors may be covered and stored in tilted positions. Also, while motors of particular designs are used for illustration purposes, it is to be understood that the invention is not limited to a motor of any specific design.

FIG. 1 illustrates a specific embodiment of a cover, generally 10, adapted to enclose and protect an outboard motor, generally 12. Cover 10 is comprised of a bag-shaped, flexible covering 14 shaped to enclose motor 12, a draw string 16 securing around the neck of covering 14 to secure covering 14 around motor 12 to reduce heat loss, a resistance heating strip 18 secured in a spiral configuration to the interior of covering 14. A thermostat 20 is located inside covering 14, and joins an end of heating strip 18 to an electrical cord 22, terminating at its other end with an electrical plug 24, so that cord 22 can be connected to a source of electricity, such as a wall outlet or a battery. Thermostat 20 is preset to activate heating strip 18 at a first predetermined temperature, and to deactivate strip 18 at a second, higher predetermined temperature.

In use, covering 14 is drawn over motor 12 and drawstring 16 is tightened about motor 12. Heating strip 18 is connected to a source of electricity. When the temperature within the interior of cover 12 falls to the activation temperature, heating strip 18 is activated to heat the interior cavity of cover 10, thus preventing motor 12 from freezing.

FIG. 2 is a detailed view of a section of heating strip 18 secured to the inner wall of covering 14 with a strip of tape 24. Strip 18 includes a conductive wire 26 and an insulating covering 28.

FIG. 3 illustrates an alternative cover 30 for use in protecting an inboard-outboard motor 32. Cover 30 is similar in construction and use to cover 10, and is comprised of a bag-shaped, flexible covering 34 shaped to enclose motor 32, a draw string 36 securing covering 34 around the neck of motor 32, a resistance heating strip 38 secured in a spiral configuration to the interior of covering 34, a thermostat 40 located inside covering 34, joined an end of heating strip 38 to an electrical cord 42, which terminates at its other end with an electrical plug 44.

Certain modifications and improvements will occur to those skilled in the art upon a reading of the foregoing description. For example, an insulation layer can be positioned adjacent the interior wall of the covering to reduce heat loss, or a drain opening can be included in the lower part of the covering. In addition, the cover can be adapted for use with an inboard motor of a boat stored in an unheated environment. It should be understood that all such modifications and improvements have been deleted herein for the sake of conciseness and readability but are properly within the scope of the follow claims.

What is claimed is:

1. A protective cover for a boat motor attached to the transom of a boat comprising:

a) a flexible, bag-shaped covering having a neck, the covering forming a cavity for enclosing said motor, the covering having an interior wall;

b) a closure attached to the covering at the neck, the closure being adapted to secure the neck adjacent the transom;

c) a heating element within the covering; and d) a control means for activating the heating element when the temperature within the cavity is below a predetermined temperature.

2. The protective cover of claim 1, wherein the heating element is a heating strip secured to the interior wall of the covering.

3. The protective cover of claim 2, wherein the heating strip is secured to the interior wall with tape.

4. The protective cover of claim 2, wherein the strip is positioned in a spiral around the interior wall.

5. The protective cover of claim 1, wherein the flexible covering is constructed of a waterproof, fire resistant material.

6. The protective cover of claim 1, wherein the control means is a thermostat located within the cavity.

7. The protective cover of claim 6, wherein the thermostat is located in the upper end of the covering.

8. The protective cover of claim 1, wherein the boat motor is an outboard motor attached to the transom of a boat.

9. A protective cover for an outboard motor attached to the transom of a boat with a mounting bracket comprising:

a) a flexible, bag-shaped covering having a neck, the covering forming a cavity for enclosing said motor, said covering having an interior wall adjacent the motor;

b) a closure attached to the covering at the neck, the closure being adapted to secure the neck around the mounting bracket adjacent the transom;

c) a heating element secured to the interior wall of the covering, the heating element including a resistance heating strip and an electrical cord to connect the strip to an electrical outlet; and d) a thermostat between the strip and the outlet to activate the heating element when the temperature within the cavity is below a predetermined temperature.

10. The protective cover of claim 9, wherein the heating strip is secured to the interior wall with tape.

11. The protective cover of claim 9, wherein the strip is positioned in a spiral around the interior wall.

12. The protective cover of claim 9, wherein the flexible covering is constructed of a waterproof, fire resistant fabric.

13. The protective cover of claim 9, wherein the thermostat is located in the upper end of the covering.

* * * * *